United States Patent [19]

Heikki

[11] 4,363,348

[45] Dec. 14, 1982

[54] LIFT WALL PROVIDED WITH LIFTING MACHINERY

[76] Inventor: Hämäläinen Heikki, SF-31300 Tammela, Finland

[21] Appl. No.: 285,529

[22] Filed: Jul. 21, 1981

[30] Foreign Application Priority Data

May 22, 1981 [FI] Finland ..... 811590

[51] Int. Cl.[3] ..... A47H 5/00

[52] U.S. Cl. ..... 160/84 R

[58] Field of Search ..... 160/84 R

[56] References Cited

U.S. PATENT DOCUMENTS 4,194,549 3/1980 Lovgren ..... 160/84 R

FOREIGN PATENT DOCUMENTS 40828 2/1969 Finland ..... 160/84 R 13740 of 1888 United Kingdom ..... 160/84 R

*Primary Examiner*—Peter M. Caun

*Attorney, Agent, or Firm*—McAulay, Fields, Fisher, Goldstein & Nissen

[57] ABSTRACT

A lift wall comprising a ceiling module to which two wall cloths have been affixed and within which a lifter and power units are accommodated, the lift wall together with its ceiling module constituting one unitary unit mountable as such on the ceiling. The wall cloths are mutually connected by framelike connector elements, with the wall cloths spaced at a constant distance from each other. The connector elements are located over each other in registry and mutually spaced. The lower edge comprises an elongated lower edge element lying in a horizontal plane and running parallel with the wall to which wall cloths and lifting members are affixed. Two elongated lower bracing arms running parallel with a lower edge element and attached thereto with the aid of linkage arms pivoted in a vertical direction, at right angles to the wall plane and placed in registry with each other to be displaceable with reference to the lower edge element upward and in braced fashion to either side, the bracing arms being disposed between the wall cloths in such manner that the cloths are folded to the sides, braced by the bracing arms, when the lower edge element is lifted up with the aid of the lifting members.

7 Claims, 7 Drawing Figures

LIFT WALL PROVIDED WITH LIFTING MACHINERY

BACKGROUND OF THE INVENTION

1. Field of the Invention

The present invention concerns a lift wall provided with a lifting mechanism and comprising two wall cloths made of elastic material for suspension by their upper edges from the ceiling with substantially constant spacing; a lower edge means to which the lower edges of both wall cloths have been affixed; a lifting means provided with a power means and at least two rope-like lifting members affixed to the lower edge means for lifting and lowering the wall with the aid of the lifting means driven by the power means, and supported by the lifting members.

Lift walls such as described above are used for the purpose of subdividing a hall, an assembly area, and other similar spaces for use on different occasions. Lift walls are advantageous for multi-purpose premises in view of rational use of space, for solving space problems and for reducing the excessively high building costs arising from fixed walls and eliminating unpractical room arrangement solutions.

For a lift wall to be usable towards meeting the requirements stated above, there are imposed strict requirements. The lift wall must be easy to mount, and mounting on any kind of ceiling should be feasible. The lift wall should be rapidly liftable and lowerable. The lift wall should be reliable in operation and easy to servicee and maintain. The lift wall should be sound-deadening and have a high structural strength so that it also tolerates mechanical stresses acting laterally on the wall. Moreover the wall should be reasonably priced as to its costs. Furthermore, the lift wall should use up little space when lifted to the ceiling, and it should be aesthetically acceptable.

2. Description of the Prior Art

Lift walls of the prior art fail to meet these requirements. The lift walls of the prior art are usually based on a lifting means disposed separate from the wall, for instance above the ceiling or in another room in a special motor space, and connected to operate the wall with the aid of wires. The installation of such lift walls of the prior art is exccedingly awkward; their installation in a completed building is usually not feasible afterwards other than with major alterations; the correct running of the wires and their operation is unreliable, the lifting means (e.g. one mounted on top of the ceiling) is difficult to service; moreover, such lift walls of prior art require extra space for their power means and lifting members. Furthermore, lift walls of the prior art are unsatisfactory as regards their mechanical strength. Furthermore, the initial price of lift walls of the prior art is high, owing to the lifting means and lifting members which have to be installed separately, in separate accommodation space. All considered, lift walls of the prior art are unsatisfactory in properties, price and appearance. In addition, lift walls of the prior art when lifted up are space-consuming and aesthetically unsatisfactory as the covering fabrics belonging thereto hang down in a disfiguring manner when the wall is in the lifted-up position.

SUMMARY OF THE INVENTION

Another object of the present invention is to eliminate the drawbacks mentioned. The object of the invention is to provide a new type of lift wall which is easy to install in spaces of any kind and which is easy to operate and reliable in operation. It is a further object of the invention to provide an easy-to-service, small space consuming and mechanically strong lift wall and one which is favourable in its initial and operating costs.

Regarding the features which are characteristic of the invention, reference is made to the claims.

The lift wall of the invention constitutes a coherent unitary structure which as it is, with all the apparatus and members pertaining thereto is installable as one single entity. The lift wall can be installed in spaces of any kind; the lift wall imposes no special requirements on the installation site. Servicing and potential repairs on the means are easily implementable, owing to the unitary construction. By reason of the unitary construction, the lift wall is aesthetically pleasing; moveover its space requirements are less than in the case of lift walls known in the art. The lift wall is furthermore of a durable construction and is well able to stand lateral stresses imposed on the wall.

BRIEF DESCRIPTION OF THE DRAWING

The invention is described in the following with the aid of an embodiment as an example with reference to the attached drawing, wherein.

DESCRIPTION OF THE PREFERRED EMBODIMENTS

Figure 1:
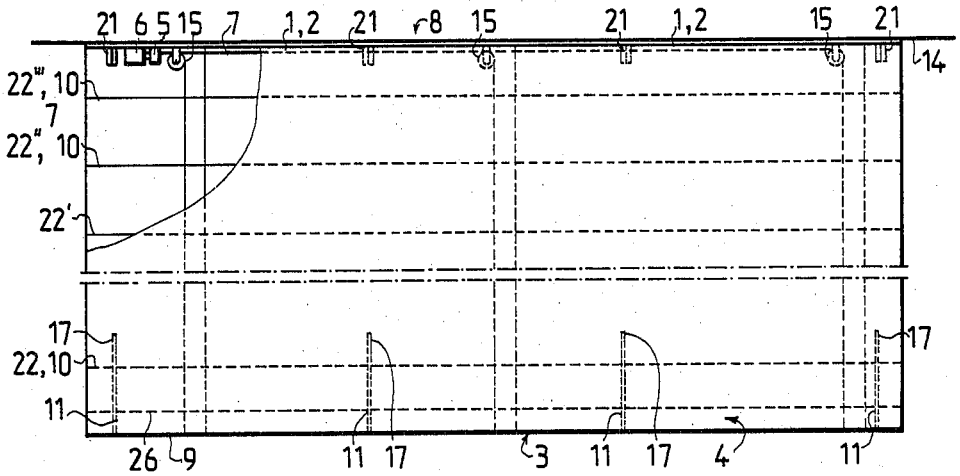
FIG. 1 presents schematically, a lift wall according to the invention, in elevational view and with the lift wall in its lowered position.
Figure 3:
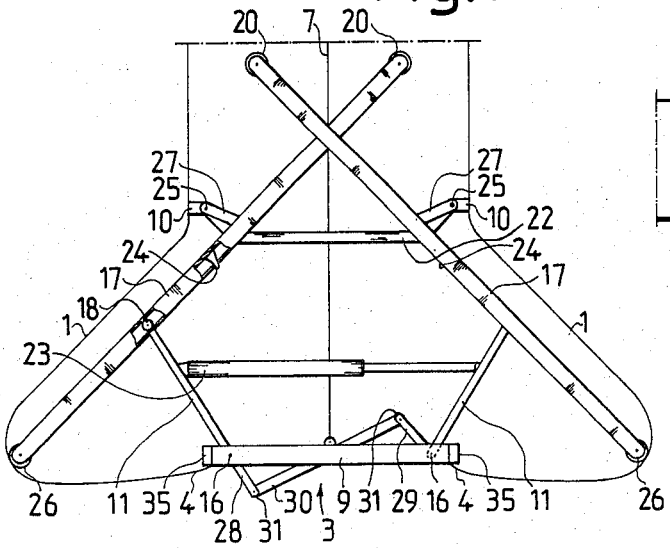
FIG. 3 shows the lower edge of the lift wall of FIGS. 1 and 2, viewed from the end thereof, with open end, at the beginning of lifting.
Figure 2:
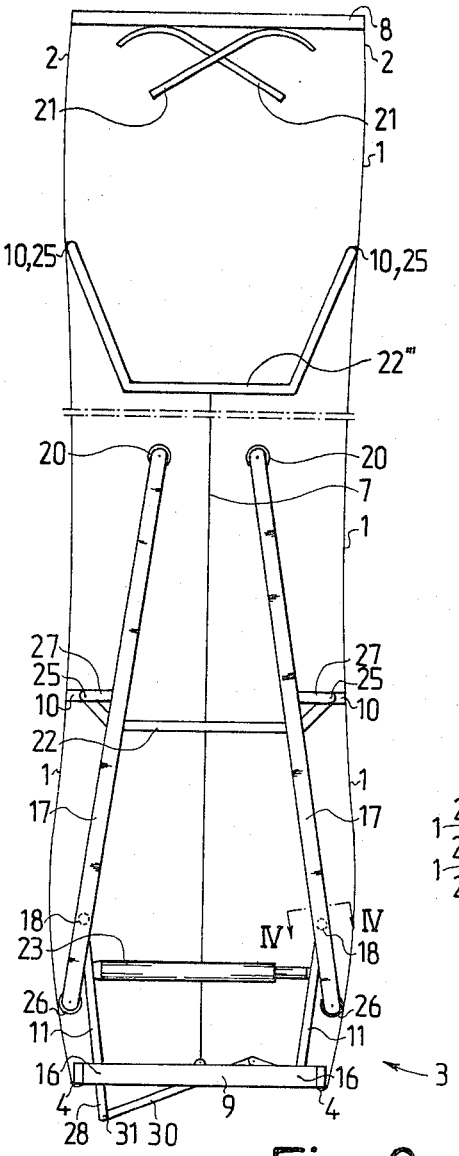
FIG. 2 shows the lift wall of FIG. 1, viewed from the end, with its end opened and with the wall in lowered position.

The lift wall presented in FIGS. 1–3, according to one embodiment of the invention, comprises two wall cloths 1 made of resilient material and suspended by their upper edges 2 from the ceiling 14 with a substantially constant mutual spacing. The wall furthermore comprises a lower edge means 3, to which the lower edges 4 of the wall cloths 1 have been attached. Furthermore the lift wall comprises a lifting means 5 provided with a power means 6 and with rope-like lifting members 7, affixed to the lower edge means 3, for lifting and lowering the wall with the aid of the lifting means driven by the power means and supported by the lifting members.

As taught by the invention, the lift wall commprises a ceiling module 8, to which the wall cloths 1 are affixed and at which the lifting means 5 with its power means 6 and lifting members 7 are disposed. Thus the lift wall together with its ceiling module 8 constitutes a unitary entity mountable as such on the ceiling and comprises the apparatus and members required for lifting and lowering the wall. It is thus understood that the lifting and/or power means or the lifting members of the wall are not separately installed; installation of the wall is accomplished by fixing the ceiling module 8 to the ceiling. The ceiling module 8 consists e.g. of one or several elongated beams parallelling the wall and to which the wall components are attached.

The lifting means 5 and power means 6 (for instance an electric motor) of the lift wall depicted in FIG. 1 are affixed to the ceiling module 8 so as to be thus installed close to the ceiling. The rope-like lifting members 7 are connected to the lifting means and are arranged to slide, carried by sleeves 15 attached to the ceiling module 8, and are affixed to the lower edge means 3 of the wall. On starting the electric motor 6 of the lifting means 5, the lifting means 5 begins to pull at the lifting members 7, whereby these, being affixed to the lower edge, lift the wall upwardly. The lifting means 5 may comprise e.g. a rotatable roll means and/or roll-resembling means to which the lifting members are conducted for winding them on the roll. For the purpose of servicing the lifting means 5, power means 6, lifting members 7, sheaves 15 and other pieces of equipment affixed to the ceiling module 8, one of the two wall cloths 1 may be provided with an aperture closable e.g. with the aid of a zipper for the implementation of such servicing. The pulling members 7 may be provided e.g. with safety alarm equipment connected e.g. to the power means 6 in order to stop the operation of the wall in the event of detachment or breaking of one of the wire ropes. The ceiling module 8 may be attached to the ceiling e.g. by bolting or by other equivalent fixing means known in the art.

FIG. 2 displays, as viewed from the opened end of the wall, the lower edge means 3 of the embodiment just presented. The lower edge means 3 comprises an elongated lower edge element 9, such as a beam made of sheet material, to which the lower edges 4 of the wall cloths 1 and the lifting members 7 have been affixed; the connector element 22 for the cloths; and two elongated lower bracing arms 26 parallelling the lower edge element and which have been connected with the lower edge element with the aid of linkage arms 11 placed in register mutually and pivotally attached by their lower ends in a vertical direction to said lower edge element at right angles to the wall plane, to be displaceable parallelly upward and, with bracing, to either side. The lower bracing arms 26 are disposed between the wall cloths 1 so that the cloths will be folded to the sides, carried by the bracing arms, when the lower edge element 9 is lifted up by the aid of the lifting members 7. In the embodiment presented, the linkage arms 11 are pivotally attached by pivots 16 to the top surface of the lower edge element 9 at a distance from the lateral edges of this element.

Figure 6:
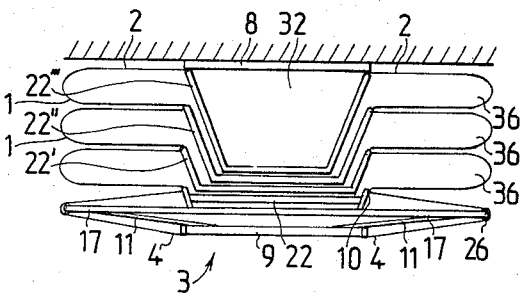
FIG. 6 displays the wall of FIGS. 1–3, lifted up, with open end and viewed from the end.
Figure 7:
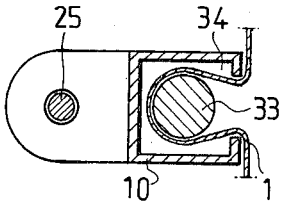
FIG. 7 displays the mode of attachment of the wall fabric to the bracing arm of the connector element.

In the embodiment presented in FIG. 2, the lower bracing arms 26 are attached to the linkage arms 11 with the aid of slide rods 17 connected to the latter, whereby the end of the linkage arm opposite to the lower edge element is slidable along the slide rod a certain distance from its other end, adjacent to the linkage arm, up to the slide stop 24. The lower edge means comprises a plurality of slide rods 17 disposed side by side in the breadth direction of the wall parallel with each other and mutually connected at their ends adjacent to the linkage arms 11 by means of the lower bracing arm 26 and by the opposite parts of the slide rods with the aid of the bracing arm 10 of the connector element 22 connecting the wall cloths 1 with each other with a given spacing, the slide rods having been pivotally attached to the last-mentioned bracing arm with the aid of pivots 25 turnable in the vertical plane at right angles to the plane of the wall. At commencement of the lifting of the wall (FIGS. 2 and 3) accomplished by lifting the lower edge element 9 upwardly by lifting members 7, the linkage arms 11 are substantially upright, their upper ends tilted slightly outward. The wall cloths 1 maintain a given mutual spacing, are connected with the aid of the bracing arms 10 of the connector element 22 and braced by the lower bracing arms 26 of the linkage arms 17, and affixed by their lower edge to the lower edge element 9. When the lifting begins, the linkage arms 11 rise upward, the tension of the cloths 1 between the lower edge element 9 and the bracing arms 10 of the connector elements 22 is released, whereby the linkage arms 11 turn outward and the top ends of the linkage arms, sliding along the parts adjacent to the linkage arms of the slide rods 17, the slide and linkage members 18 in contact with the slide rods and whereby the lower ends of the slide rods then turn outward as shown in FIG. 3. On hitting against the slide stops 24, the upper ends of the linkage arms 11 give support to the slide rods 17 and thereby to the connector element 22 and, partly, to the wall cloths 1. The linkage arms 11 will then turn to a substantially horizontal position (FIG. 6), bracing themselves against the supporting shoulders 35 constituted by the edges of the lower edge element 9. As the lower edge element 9 is further lifted by the lifting members 7, the wall folds up, the connector elements 22 settling into each other, as shown in FIG. 6. On approaching the ceiling module 8, the slide members 20 attached to the upper ends of the slide rods 17 meet the respective points on the downwardly curved guide rails 21 which are part of the ceiling module and which have been arranged to guide the upward pushing upper ends of the slide rods to approach the opposite surface of the wall so that the slide members cause the slide rods to turn into a horizontal direction while the slide pivot components 18 braced by the slide rods of the linkage arms slide along the slide rods from the slide stop 24 to the lower ends adjacent to the linkage arms of the slide rods, whereby the slide rods both turn towards each other, to cross in a substantially horizontal position as shown in FIG. 6. In this position, the lower ends of the slide rods, that is the ends adjacent to the linkage arms 11, are pushed to the side, and the parallel lower bracing arms connecting the slide rods at their lower ends are pushed to both sides of the wall, constituting together with the cloth, turning about the lower bracing arms, a board-like base upon which the folds 36 of the wall elements rest while the wall is in its lifted position, as shown in FIG. 6.

Figure 5:
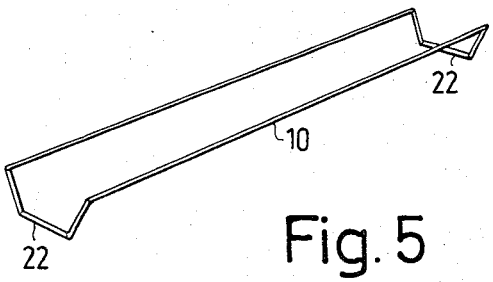
FIG. 5 displays the connector element belonging to the wall of FIGS. 1–3 with its bracing arms, in vertical section.

The connector elements 22 consist of, preferably upwardly widening, frames fitted one within the other in a vertical direction and each comprising two mutually parallel bracing arms 10 disposed with a spacing equivalent to the thickness of the wall. One such connector element 22 has been depicted in FIG. 5. The connector elements 22 located upon each other have been preferably so shaped that the topmost has the greatest height, the lifting means 5 with its power means and its lifting members are accommodated within the topmost connector element 22'''. The lower connector elements 22'', 22' and 22 are lower, in this order, as shown in FIG. 6. The lifting means 5 has not been depicted in FIG. 6, for the sake of clarity.

In FIGS. 2 and 3, the linkage arms 11 have been interconnected, two and two, by mediation of shock absorbers 23, the aim being to damp any abrupt motions of the linkage arms during the wall lifting operation. Furthermore, the linkage arms 11 have been interconnected, two and two, at their lower ends by synchronizing members, such as e.g. linkage arms 28, 29 and 30, so that the motion of the linkage arms will take place in step, simultaneously.

Figure 4:
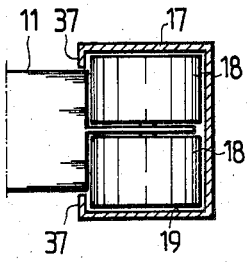
FIG. 4 shows the section taken along the line IV—IV in FIG. 2.

In FIGS. 2, 3 and 6, there is shown the placement of the linkage arms and slide rods in the sectional view of the wall, that is at right angles to the wall. The linkage arms 11 and the slide rods 17 are placed in registry, two and two, the slide rods intercalated, perpendicularly against the wall. FIG. 1 shows the placement of the linkage arms 11 and of the slide rods 17 in the breadth direction of the wall. The linkage arms 11 and the slide rods 17 are disposed in pairs, each pair spaced from the next in the breadth direction of the wall. The frame-like connector elements 22 extend from one edge of the wall to its opposite edge. FIG. 4 reveals the construction of the end of the linkage arm 11 and of the slide rod 17. On the end of the linkage arm 11 are mounted two slide rollers 18, which are freely movable in the box-like groove 19 of the slide rod 17. The slide rod is freely movable, carried by the slide rod between the lower bracing arm 26 and the slide stop 24, the shoulder borders 37 of the slide rod preventing the end of the linkage arm from losing contact with the slide rod.

The bracing arm 10 likewise comprises a box-like interior space 34, in which the wall cloth 1 has been secured e.g. by means of a locking pin 33. The bracing arm 10 is provided with a pivot 25 to which the slide rod 10 is pivotally attached to be turnable in the vertical plane. To the slide rod 17, there is integrally connected an arm-like fixing element 27 projecting outward with reference to the wall, and to its outer end, there is pivotally attached the bracing arm 10 by the pivot 25, the inner end thereof being integrally affixed to the slide rod.

The embodiment examples are meant to illustrate the invention, without restricting it in any way whatsoever. The invention may therefore if desired also be applied in such manner that the bracing arms 10 are connected with each other, in the breadth direction of the wall, the top ends of the mutually parallel linkage arms 11, whereby the slide rods with their lower bracing arms are not needed indispensably at all. If desired, each connector element 22 may comprise linkage arms 11 with their bracing arms 10.

What I claim is:

1. A lift wall provided with lifting machinery, comprising two wall cloths each made of resilient material and suspended by their upper edges from a ceiling with substantially constant mutual spacing;

lower edge means to which lower edges of both wall cloths are attached;

lifting means provided with power means and at least two rope-like lifting members affixed to said lower edge means for lifting and lowering the wall with the aid of said lifting means driven by said power means and supported by said lifting members;

a ceiling module to which said wall cloths are attached and in which said lifting means with its said power means are accommodated;

said lift wall with said ceiling module constituting a unitary entity mountable on the ceiling;

said lower edge means comprising an elongated lower edge element in the horizontal plane and parallelling the wall, and to which said wall cloths and said lifting members are affixed;

a lower edge connector element; and two elongated lower bracing arms parallelling said lower edge element and connected to said lower edge element by the aid of linkage arms thereto pivotally attached in a vertical direction at right angles to the plane of the wall to be displaceable with reference to said lower edge elements parallelly upward and in braced fashion to either side, and bracing arms been placed between said wall cloths in such manner that said cloths are folded to the sides, supported by said bracing arms, when said lower edge element is lifted up with the aid of said lifting members.

2. Lift wall according to claim 1 wherein each said linkage arm is connected to a slide rod so that the end of the linkage arm opposite to said lower edge element is slidable along said slide rod a given distance from the latter's other end, i.e., its end adjacent to said linkage arm, up to a slide stop; and said slide rods next to each other in the wall's breadth direction are connected with each other at their said other ends by a lower bracing arm guiding the folding of the cloth and by parts of the arms opposite with reference to said other ends with said lower edge connector element in the vertical plane, and turnable, on pivots, at right angles against the plane of the wall.

3. Lift wall according to claim 2, wherein said slide members are attached to said last-mentioned ends of the slide rods;

said ceiling module comprises downwardly curving guide rails disposed in registery with said slide members for guiding and securing the opposite ends of said slide rods against the opposite surface of the wall when the wall is being lifted up by lifting at said lower edge element, whereby the linkage arms are braced against said lower edge element;

said slide rods are braced against said linkage arms by said slide stops and said wall cloths are braced by said connector elements, and said guide rails, as the slide members of the slide rods hit against these during the lifting operation, cause the turning of said slide rods to be horizontal while the components braced against said slide rods of the linkage arms slide along said slide rod from said slide stop to the end adjacent to said linkage arm.

4. Lift wall according to claim 1 wherein said wall cloths are attached to each other by means of frame-like connector elements, said wall cloths are spaced at a constant distance, and said connector elements are located spacedly over each other.

5. Lift wall according to any one of claims 1 to 4, wherein said linkage arms are in registry with each other in a direction at right angles against the wall and are connected with each other two and two by mediation of a shock absorber.

6. Lift wall according to any one of claims 1 to 4 wherein said linkage arms are in registry with each other in a direction at right angles against the wall are connected with each other two and two by means of synchronizing members, such as pivoted arms.

7. Lift wall according to any one of claims 1 to 4 wherein said connector elements are composed of upwardly widening frames fitted into each other in the vertical direction, each comprising two parallel bracing arms disposed with a mutual spacing consistent with the thickness of the wall.

* * * * *